United States Patent [19]

Pleyber

[11] 4,270,041

[45] May 26, 1981

[54] PROCESS AND APPARATUS FOR DETECTING THE PRESENCE OF A PHYSICAL PHENOMENON

[75] Inventor: Gaëtan Pleyber, Domene, France

[73] Assignee: Commissariat a l'Energie Atomique, Paris, France

[21] Appl. No.: 945,014

[22] Filed: Sep. 22, 1978

[30] Foreign Application Priority Data

Oct. 3, 1977 [FR] France ..... 77 29652

[51] Int. Cl.[3] ..... G07C 1/10; G06M 3/14

[52] U.S. Cl. ..... 235/92 MT; 235/92 CA; 235/92 TF; 235/92 EV; 364/550

[58] Field of Search ..... 235/92 CA, 92 MT, 92 T, 235/92 TF, 92 EV; 340/661; 364/550, 574

[56] References Cited

U.S. PATENT DOCUMENTS

| | | | |
|---|---|---|---|
| 3,769,844 | 11/1973 | Skoures | 235/92 CA |
| 3,955,070 | 5/1976 | Suzuki et al. | 235/92 CA |
| 4,031,365 | 6/1977 | Raggiotti et al. | 235/92 MT |
| 4,124,840 | 11/1978 | Kobayashi | 364/550 |
| 4,165,458 | 8/1979 | Kolzumi et al. | 235/92 TF |

*Primary Examiner*—Joseph M. Thesz

[57] ABSTRACT

The invention relates to a process and apparatus for detecting the presence of a physical phenomenon. The apparatus comprises a sensor which is sensitive to a characteristic quantity of the phenomenon to be studied and supplies a signal which is representative of the phenomenon. An amplifier is connected to the output of the sensor and an indicator for indicating passing beyond the threshold is connected to the amplifier. A differentiating circuit differentiates the amplified signal, while a comparator compares the differentiated signal as soon as a reference potential is exceeded. A time sampling circuit fixes prealert periods as soon as the reference potential is exceeded. The invention is applicable to the detection of pollution by combustible gaseous vapors, oil slicks, firedamp, thunderstorms, defects in surface states, etc.

6 Claims, 8 Drawing Figures

PROCESS AND APPARATUS FOR DETECTING THE PRESENCE OF A PHYSICAL PHENOMENON

BACKGROUND OF THE INVENTION

The present invention relates to a process and to an apparatus for detecting the presence of a physical phenomenon. This process and this apparatus are for example applicable to the detection of nuisances such as the presence of a pollutant in the air. It is also possible to envisage the use of this process and apparatus for detecting combustible vapours such as hydrocarbon vapours floating on water. This process and apparatus may also be used for determining the hygrometry of the air, for detecting thunderstorms, for detecting fire damp in mines, for detecting the presence of a colour, for checking surface states, etc.

It is known that the detection of a physical phenomenon is of particular interest in the study of nuisances. Thus, the discomfort which may result from a disturbing or perturbing agent can be just as great in the case of rapid variations of a low content of said agent and in the case of a high constant content. The perception of odours for example is linked to the level of the concentrations of these vapours in the air. The continuous measurement of the concentrations reveals very rapid variations of the instantaneous values. The amplitude of these variations is dependent on the heterogeneity of the pollutant-air mixture swept along by the wind. For a stationary observer, the variations in the concentrations of pollutant vapours occur when the pollution front arrives and may be reproduced as a result of the displacement of the plume formed by the vapours. A plume is never homogeneous and an observer will only observe a fixed vapour concentration if he remains on a single air flow line and if the pollutant source has a constant flow rate. However, this case is very rare, because air has a natural turbulence and consequently there is a certain spatial distribution of the pollutant in the air. The heterogeneity of the pollutant-air mixture consequently leads to a polluting turbulence, whose appearance is called "emergence" of the pollutant.

For measuring the pollution of a site, it is known to use an apparatus comprising a detector sensitive to the phenomena to be studied, means for amplifying and sampling the signals supplied by the detector and means for comparing the sampled signal with a threshold value. This sampling makes it possible to determine if for a given period the amplified signal from the detection means has exceeded a threshold value beyond which it is almost certain that a phenomenon exists.

The detectivity of such an apparatus is low in the case where the phenomenon is only slightly perceptible. This detectivity is limited on the one hand by the drift of the apparatus and on the other by the amplitude of the background noise resulting from the experimental conditions. Thus, under severe experimental conditions, certain very sensitive apparatus cannot be used. These problems can be obviated, but only as a result of making the equipment excessively complicated and in particular by realising a frequency spectral analysis of the signal representative of the phenomenon in order to reveal certain perturbations essentially due to the background noise superimposed on the signal which is representative of the phenomenon in question.

BRIEF SUMMARY OF THE INVENTION

The object of the present invention is to obviate the disadvantages and in particular to provide a process and apparatus permitting the recognition of the existence of physical phenomenon and also permitting a qualification of the importance or magnitude of these phenomena without it being necessary to needlessly complicate the apparatus as a result of variations in these components and the presence of a background noise accompanying the signals which are representative of the phenomena.

The present invention relates to a process for the detection of the presence of a physical phenomenon by means of a detector, wherein it comprises:

the delimitation on the basis of the characteristics of the signal emitted by the detector of a range delimited in a system of coordinate axes by a curve representing the variation of a magnitude characteristic of the phenomenon, as a function of the time during which said magnitude retains a predetermined value with a given approximation, said time being called persistence, in such a way that it is possible to consider that the phenomenon is present for any point representing a magnitude characteristic of the phenomenon and which is located within the range;

a time sampling of the range in prealert periods, the characteristic magnitude of the phenomenon being measured at the start of these prealert periods, each of said periods having a time $\tau$ linked with the value of the characteristic magnitude of the start of sampling and to the position, relative to the curve defining the range, of the point representing said characteristic magnitude, the latter being measured during this period in such a way as to define a prealert state on each occasion when the representative point reaches the range;

a further sampling operation of the range in alert periods of duration $T>\tau$, during which it is possible to define an alert state as soon as the number $N_p$ of prealerts is equal to or above a given number $N_{al}$, the numbers $N_p$ and $N_{al}$ being integers and the number $N_{al}$ being selected in such a way that $1<N_{al}<T/\tau$.

According to a special feature of the invention, the characteristic magnitude of the phenomenon is the derivative compared with the amplitude time of the signal from the detector.

According to another advantageous feature of this process, the threshold for which commences the sampling of the range in prealert periods is the quotient $e/\tau$ of the maximum amplitude e of the background noise accompanying the signal which is representative of the phenomenon and the value $\tau$ of the prealert period.

The invention also has for its object an apparatus for the detection of the presence of a physical phenomenon comprising:

a sensor sensitive to a characteristic magnitude of the phenomenon to be detected and able to supply a signal representative of said phenomenon;

at least one amplifier connected to the sensor output;

means for indicating passing beyond a predetermined threshold significant for the phenomenon to be detected, said means being connected to the amplifier output; wherein the means for indicating exceeding the significant threshold comprise:

a differentiating circuit connected to the amplifier output and supplying a signal which is the derivative relative to time of the signal representing the phenomenon;

a comparator whose one input is connected to the output of the differentiating circuit and whose other input is raised to a prealert reference potential, said comparator being able to supply a signal for initiating the prealert as soon as the amplitude of the differentiating circuit signal exceeds the amplitude of the reference potential;

a first time sampling circuit for fixing the elementary prealert periods of duration $\tau$ as soon as the comparator supplies a first signal for initiating the prealert;

a second time sampling circuit for fixing alert periods of duration $T>\tau$ and a prealert counter able to count during the alert periods of duration T the number $N_p$ of prealert sampling periods during which the reference potential is exceeded;

alert display means connected to the prealert counter output for indicating the presence of an alert during time T as soon as the number $N_p$ of prealerts exceeds a predetermined number $N_{al}$, the number $N_p$ and $N_{al}$ being integers and the number $N_{al}$ being selected in such a way that $1<N_{al}<T/\tau$.

According to a special feature of the apparatus, the prealert reference potential is fixed as a function of the maximum amplitude of the background noise accompanying the representative signal during time $\tau$.

BRIEF DESCRIPTION OF THE DRAWINGS

Other features and advantages of the invention can be gathered from the following description of non-limitative embodiments, with reference to the attached drawings, wherein show.

DETAILED DESCRIPTION OF THE PREFERRED EMBODIMENTS

Figure 1:
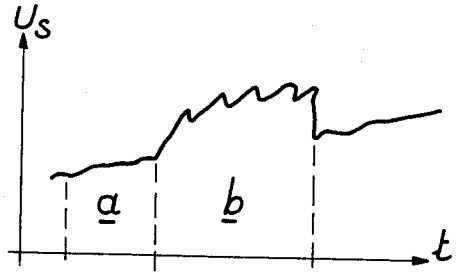
FIG. 1 a diagram giving the variations as a function of time of the amplitude $U_s$ of a signal representative of a physical phenomenon, such as for example variations in the concentration in the pollutants in the air.

FIG. 1 shows as a function of time t, the variations of voltage $U_s$ observed for example at the terminals of an amplifier connected to a sensor sensitive to the presence of a pollutant in air. This voltage $U_s$ is representative of the concentration variations of this pollutant. Zone a of the diagram defines a time period during which the pollutant is absent and during which it is consequently impossible to detect any perturbation. Zone b of the diagram represents a time period during which the pollutant appears. As a result, voltage variations occur at the terminals of the amplifier and therefore perturbations are revealed on the diagram. It is during these time periods, as represented in zone b of the diagram, that it is possible as a result of the process and apparatus of the invention to define the presence of a pollutant or any other physical phenomenon and trigger off an alert.

Figure 2:
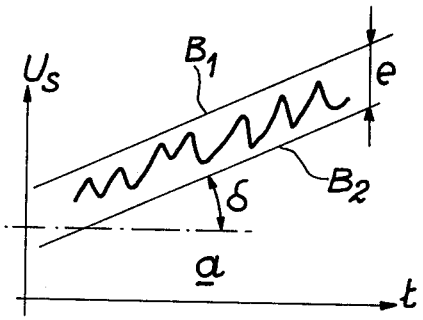
FIG. 2 zone a of the signal of FIG. 1.

FIG. 2 shows in more detailed manner zone a of the signal of FIG. 1. In this case, there is no perturbation due to the presence of a pollutant and voltage $U_s$ appearing at the terminals of an amplifier connected to the output of a detector which is sensitive to the phenomenon to be studied is only constituted by the background noise produced by the detector and the amplifier. The background noise has maximum amplitude variations of value e and, in the absence of perturbations, is accompanied by a drift of the detector and the amplifier. This drift is represented in the drawing by the slope $p=tg\delta$ of the straight lines $B_1$ and $B_2$ between which is located the signal representative of the background noise. In the drawing, this slope is materialized by the angle $\delta$ is formed by the straight line relative to the time axis Ot. In the absence of perturbations, the only detectable signal is therefore a background noise signal of maximum amplitude e accompanied by a certain drift.

Figure 3:
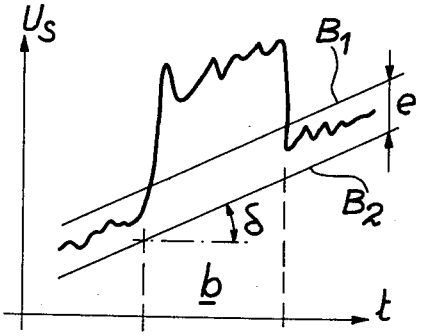
FIG. 3 a zone b of the signal of FIG. 1.

FIG. 3 shows zone b of the signal of FIG. 1. In this zone, the pollutant is present and the resulting perturbations lead to the appearance at the amplifier terminals of a signal $U_s$, whose amplitude is well above the maximum amplitude e of the background noise of the sensor and the amplifier.

Figure 4:
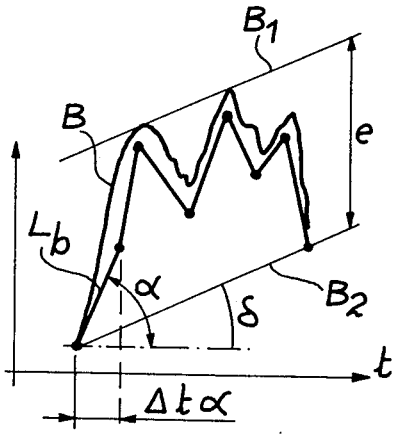
FIG. 4 a theoretical signal which is close to the signal of zone a of FIG. 1.

FIG. 4 shows in detail an approximate theoretical signal $L_b$ which is close to the signal of the undisturbed zone a of FIG. 1. In actual fact, it is always possible to approach the true ordinate curve $U_s$ representing the background noise signal B by a broken line $L_b$ of ordinate $U_b$, so that $U_b-U_s<e/n$, wherein n designates an integer which can assume a value which is a function of the largest or smallest approximation which it is desired to reach in the approach towards the true curve B, representing the background noise, by the theoretical curve $L_b$. The ascending segments of the broken theoretical line $L_b$ are characterised by their inclination $\alpha$ and by their length $\lambda_\alpha$.

The time $\Delta t_\alpha$ during which segment $\lambda_\alpha$ has a constant slope can be expressed by the relationship:

$$\Delta t_\alpha=\lambda_\alpha\cdot\cos\alpha.$$

Figure 5:
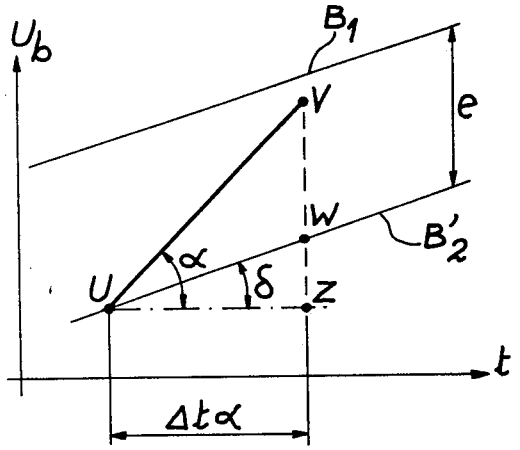
FIG. 5 part of the approximate theoretical signal of FIG. 4 in detail.

FIG. 5 shows in greater detail segment $\lambda_\alpha$ of FIG. 4 in the case where there is no perturbation. The measuring signal $U_s$ is between two terminals constituted by parallel lines $B_1$ and $B_2$ defining a band of width e and it is then possible to write:

$$p\cdot t+q-e/2<U_s<p\cdot t+q+e/2.$$

In these inequations, t designates time, p the drift of the signal, q the zero displacement of the apparatus and e the amplitude of the background noise.

The length relationship of segment $VW<e$, corresponds to this inequation and is then expressed in the following manner:

$$\Delta t_\alpha(tg\alpha-tg\delta)<e$$

p representing the signal drift being equal to $tg\delta$.

Thus, the measurement of the amplitude $U_s$ of the signal associates a variation $\Delta U_s$ with a background noise sampling period $\Delta t$, whereby e is the greatest value which can be assumed by $\Delta U_s$ when the background noise signal is sampled over a period $\Delta t$. For the different sampling periods $\Delta t_1$ and $\Delta t_2$, such as $\Delta t_1>\Delta t_2$ it is possible to write $e\cdot\Delta t_1>e\cdot\Delta t_2$.

Figure 6:
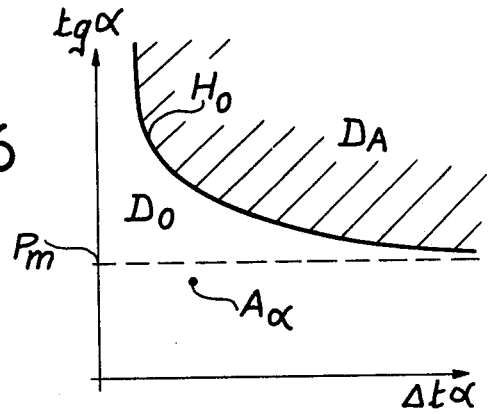
FIG. 6 a theoretical curve defining a range within which must be located a characteristic magnitude of the phenomenon to enable the latter to be detected.

FIG. 6 represents a theoretical curve defining a range $D_A$ within which must be located at magnitude characteristic of the phenomenon to be studied to enable said phenomenon to be detected. This theoretical curve is a diagram representing the variations as a function of the sampling period $\Delta t_\alpha$ of the tangent of angle $\alpha$ of elementary segment $\lambda_\alpha$. In this diagram, the segments such as $\lambda_\alpha$ are represented by points $A_\alpha$. In the case where there are no perturbations, these representative points are located outside the range $D_A$ in range $D_O$. These two ranges are defined by a hyperbola $H_O$ of equation $x(y-p)=e$. Thus, in the case where there is no perturbation, the hyperbola $H_O$ represents a boundary above which there must be no point $A\alpha$. In this case, the broken line $L_b$ is contained completely in the band of width e, no matter what the value chosen for n. The maximum value of the tangent of angle $\alpha$, designated by $p_m$, constitutes an asymptote for the hyperbola. If n is very large, the approximate value $U_b$ of the voltage approximated by curve $L_b$ is equivalent to the true voltage $U_s$ and it is then possible to accept that $tg\alpha$ represents the derivative $dU_s/dt$ of the signal characteristic of the phenomenon at the point in question. In other words, the derivative $dU_s/dt$ of the signal when there is no perturbation cannot exceed a value $p_s$ during a sampling time $\Delta t$ defined by the relationship $\Delta t=e/(p_s-p_m)$.

In this relationship, $p_m$ designates the maximum slope of segment $\lambda_\alpha$.

When the theoretical broken line $L_b$ associated with the signal characteristic of the phenomenon passes outside the band of width e representative of the background noise, i.e. when in zone b of FIG. 1, there is a perturbation and points such as $A_\alpha$ are located within range $D_A$ above hyperbola $H_O$, which represents the limit of an alert range $D_A$. Thus, the detection of the presence of a phenomenon consists of establishing whether during a period of time $\tau$, chosen in an arbitrary manner, the derivative $DU_s/dt$ of the signal exceeds $e/\tau$.

Figure 7:
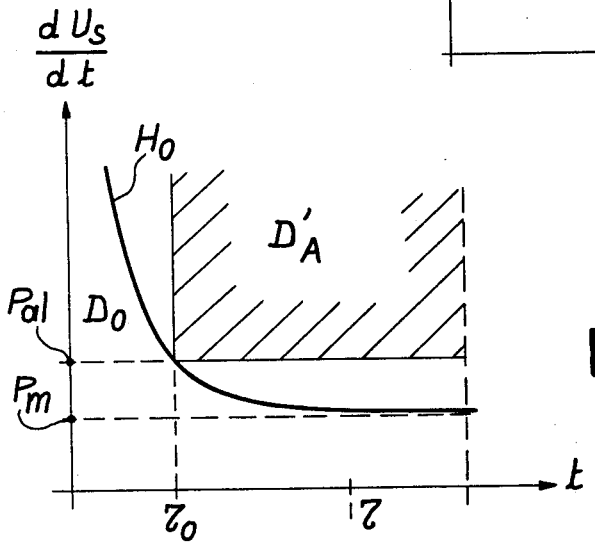
FIG. 7 another theoretical curve deduced from the preceding curve.

FIG. 7 represents a theoretical range $D_A'$ deduced from the preceding range. Thus, it is possible to define a so-called prealert range $D_A'$ located within the range $D_A$ and defined by the maximum permitted drift $p_{al}$, as well as by the time $\tau_o$ at which the first prealert appears. A state of prealert is validated if at the point of time $\tau_o$ the derivative $dU_s/dt$ of the signal exceeds $p_{al}$. The prealert range $D_A'$ is then defined by the relationships $dU_s/dt>p_{al}>p_m$ and $\tau_o<\tau<T$.

In these relationships $\tau_o$ represents the dead time equal to $e/p_{al}$, T represents a sampling time during which a certain number of prealerts are validated and $\tau$ representing the dead time or time necessary for validating a prealert.

It is also possible to define an alert procedure. If $N_p$ designates the number of prealerts counted from the start $\tau_o$ of the period T, the state of alert can be recognised as soon as $N_p$ is equal to a certain number $N_{al}$ which is sufficient to be able to declare a state of alert. This number $N_{al}$ exceeds 1, but is below a whole part N of $T/\tau$. Thus, $N_{al}$ exceeds 1, but is below N. Thus, it is possible to fix the prealert conditions by the definition of $\tau$ and $p_{al}$, whilst it is possible to fix the alert conditions by the choice of T and $N_{al}$.

The principle described in detail hereinbefore provides a better understanding of the preference of the process for the determination of the presence of a physical phenomenon according to the invention, together with the apparatus permitting the performance of this process.

The process according to the invention permits the detection of the presence of a physical phenomenon and comprises the definition of a range $D_A'$ in the system of coordinate axes representing the variation of a characteristic magnitude of the phenomenon as a function of time. Thus, if this characteristic magnitude is located within the range, it is possible to conclude that the phenomenon is present. The process first comprises a first sampling of range $D_A'$, during the elementary prealert period. Each of these periods has a duration $\tau$ and the characteristic magnitude of the phenomenon is measured during this period in such a way as to investigate whether it is located inside or outside range $D_A'$ in order to define a prealert state whenever this magnitude is located within the range. Sampling starts at time $\tau_o$ defined hereinbefore corresponding to the appearance of the first prealert, i.e. the time of first passing beyond threshold $p_{al}$. The process also comprises a second sampling of the range in the alert period of duration $T=N\cdot\tau$. During this alert period, it is possible to define a state of alert as soon as the number $N_p$ of prealerts which has appeared during the first sampling operation becomes equal to or exceeds a predetermined number $N_{al}$. This number $N_{al}$ is an integer which remains above 1, but below N. Obviously, if number $N_p$ has a relatively low value, a state of alert will be initiated very rapidly, whilst if this number has a very high value the state of alert will only be initiated at a later time. Therefore, this number is selected as a function of the desired degree of alert. The characteristic magnitude of the phenomenon is, as defined hereinbefore, the derivative relative to time of the amplitude of a signal representing said phenomenon, whilst the sampling of the range in the prealert period of duration $\tau$ starts as soon as a threshold $e/\tau$ has been exceeded, whereby e obviously represents the maximum value of the background noise accompanying the signal which is representative of the phenomenon, whilst $\tau$ is the prealert period. Obviously, the number $N_p$ which must be reached to declare a state of alert is a function of the frequency $1/\tau$ of sampling the alert range.

In the case, for example, of air pollution by gaseous vapours, the speed with which the $N_p$ prealerts permitting the definition of a state of alert are counted is linked with the significance of the increase in the vapour concentration in the air. If $d_A$ designates the time permitting the counting of $N_p$ prealerts, it is possible, through measuring this time, or through measuring its compliment $T-d_a$, to know the significance of the polluting turbulence and in particular the variations of the gaseous concentrations in the air. Thus, these measurements of $d_A$ or $T-d_A$ constitute a way of defining the seriousness of the alert.

By means of a procedure identical to that for initiating the prealerts, it is also possible to reject a certain number of alerts during a certain period in such a way that said alerts are considered as prealarms which, if rejected a certain number of times during the given period would give after a certain number of rejection operations a much more significant alarm.

Figure 8:
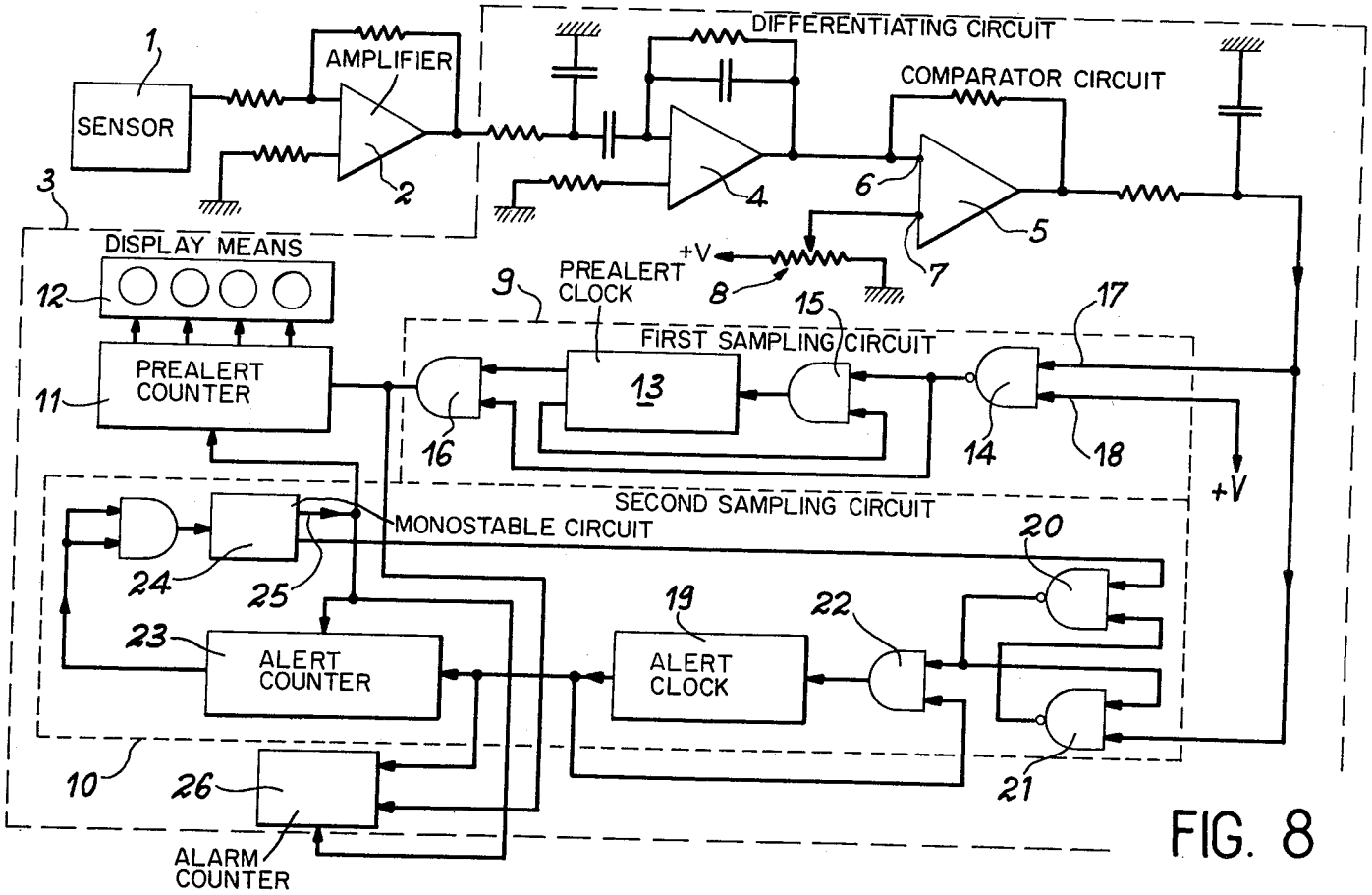
FIG. 8 diagrammatically, an embodiment of the apparatus according to the invention.

FIG. 8 diagrammatically shows an embodiment of the apparatus permitting the performance of the process according to the invention. This apparatus comprises a sensor 1 which is sensitive to the phenomenon to be studied. This sensor is connected to an amplifier 2, whose output is connected to means 3, permitting the indication of whether a threshold which is significant of the phenomenon to be detected has been exceeded. These means comprise a differentiating circuit 4 connected to the output of amplifier 2 and supplying a signal representative of the derivative relative to the time of the signal characteristic of the phenomenon. A comparator circuit 5 is connected by one of its inputs 6 to the output of the differentiating circuit 4. The other input 7 of comparator circuit 5 is raised to a prealert reference potential. The comparator supplies a signal for initiating prealerts as soon as the amplitude of the signal supplied by the differentiating circuit exceeds the amplitude of the reference potential. This reference potential is fixed by means of a potentiometer 8, one of whose ends is raised to a fixed high voltage +V. The differentiating circuit, amplifier and comparator are constructed in per se known manner by circuits including operational amplifiers. The resistors and capacitors connected to the operational amplifiers are not designated by reference numerals because they are well known in the art. The means 3 for indicating that the threshold has been exceeded, also comprise a first sampling circuit 9 making it possible to fix the duration $\tau$ of the prealert periods as soon as comparator 5 supplies a first prealert initiating signal. A second time sampling circuit 10 makes it possible to fix alert periods of duration $T=N\cdot\tau$ and will be described in greater detail hereinafter. The first sampling circuit is connected to a prealert counter 11 which, during the alert periods of duration T, counts the number of prealert sampling periods during which the reference potential is exceeded. As has been shown hereinbefore, this reference potential is fixed as a function of the maximum amplitude of the background noise, accompanying the signal which is representative of the phenomenon, supplied by amplifier 2 and detector 1 during time $\tau$. The outputs of prealert counter 11 can be connected to display means 12 permitting the indication of the presence of the alert during time T as soon as the number $N_p$ of prealerts exceeds the predetermined number $N_{al}$, which has been fixed to remove a state of alert.

The first prealert period sampling circuit 9 comprises a prealert clock 13 which supplies pulses at frequency $1/\tau$. This clock is associated with a logic circuit constituted by gates 14 of the NO-AND type 15 and the AND type 16. One of the inputs 17 of the NO-AND gate 14 is connected to the output of comparator 5, whilst the other input 18 of this gate is raised to a fixed reference potential. On exceeding a prealert threshold, comparator 5 supplies a signal indicating that the threshold has been exceeded and the gates associated with clock 13 and with prealert counter 11 make it possible for the counter to count all the clock pulses of frequency $1/\tau$ supplied throughout the time during which the threshold has been exceeded. The time limit for the counting operation is obviously fixed by the sampling period T fixed by the second sampling circuit 10.

This second sampling circuit comprises an alert clock 19 which also supplies for example alert pulses at frequency $1/\tau$. This clock is also associated with a logic alert circuit constituted by NO-AND gates 20 and 21 and by AND gate 22. The output of the clock is connected to an alert counter 23. When the prealert reference threshold is exceeded for the first time, the logic circuit associated with clock 19 triggers off said clock in such a way that it supplies pulses of frequency $1/\tau$. Counter 23 can be a forced counter at a value N in such a way as to fix the value of the sampling period $T=N\cdot\tau$. A monostable circuit 24 triggered off by the Nth pulse counted by counter 23 controls by its output 25 the resetting of alert counter 23, prealert counter 11 and alarm level counter 26. This bidirectional counter 26, whose inputs are connected to the output of the prealert clock 13 and the output of the alert clock 19 makes it possible to count the difference $N-N_p$ between the number of pulses supplied by the alert clock during time T and the number of prealert pulses counted by the prealert counter 13. This difference is in fact proportional to the time interval $T-d_A$, which represents the speed at which the alert was triggered off and which supplies an indication of the importance of the phenomenon, such as for example variations in concentrations of polluting vapours in the air.

The apparatus described hereinbefore can obviously be adapted to the phenomenon to be detected. Thus, different phenomena can be detected as a function of the detector located at the input of the apparatus.

In the case of detection of pollution by combustible gaseous vapours, the sensors used are thermosensitive elements, mainly constituted by two platinum wires. One of these wires is covered by a combustion catalyst, whilst the other wire is bare. In a neutral ambient, the resistances of these wires are equal. In a polluted ambient, a resistance difference appears between these two wires and is converted into a voltage difference by means of a Wheatstone bridge. Amplifier 2 is connected to the terminals of this bridge and the apparatus makes it possible to detect the pollution of the atmosphere by the gaseous vapours. By means of such a detector, it is therefore possible to detect slicks resulting from the discharge of hydrocarbons on the surface of the ocean. The detection of such slicks can be effected by means of a system of apparatuses according to the invention and can be in the form of a coastal or ship-borne monitoring system.

The plume of combustible vapours associated with the layer of hydrocarbons is heterogeneous. This heterogeneity of the air-pollutant mixture is aided by various factors: at the time the oil is discharged into the sea the concentration of combustible vapours swept along by the wind passes from a zero value to a value which is close to the partial pressures of the hydrocarbon vapours. The discharge of hydrocarbons is accompanied by a spreading action during which the diameter of the slick increases. The plume of vapours develops in the form of a point and the persistence of the alerts will confirm the scale of the disaster, whose location is under investigation, by outpacing the wind from the observation points. The location of the system of apparatuses according to the invention must therefore take account of the prevailing winds. Thus, the transfer of information regarding polluting turbulence is dependent on the wind levels. The information in question travels at wind speed and is delayed in calm weather, but always precedes the arrival of a slick on the coast, except when there are ocean currents permitting the slick to outpace the wind. The vigilance of the system of apparatuses increases with the wind velocity. In heavy weather, the risk of accidental oil slicks increases and in this case the transfer of information is rapid, which is favourable to a very rapid intervention.

The application according to the invention can be applied to other fields. If for example the detector is a hygrometer or an apparatus for measuring liquid water suspended in the air, the apparatus is able to recognise humid formations such as for example rain plumes or foggy or cloudy formations which are characteristic of rapid weather developments.

When the detector is an ozonemeter, the apparatus makes it possible to detect thunderstorms, by indicating ozone puffs produced by an ionisation of the air prior to the appearance of flashes of lightning. A further application of the apparatus is when an air ionisation detector or an electric field detector is associated therewith, because these two parameters make it possible to reveal the presence of storms.

All these apparatuses placed in the free atmosphere are subject to the action of the wind. They are advantageously regulated with a dead time $\tau$ equal to a few seconds (e.g. three seconds) and a sampling time of a few minutes (e.g. three minutes). This regulation makes it possible to best use the natural turbulence of the air or wind, which presents a frequency peak centered between these two values.

The input detector of the apparatus may also be an explosimeter permitting the detection of fire damp emissions in mines. In this case, the apparatus may make it possible to give the alarm, well before the explosive limits are reached.

The apparatus permitting the detection of gaseous fluids may also permit the detection of liquid fluids. In this case, for example a stationary flow, the input detector of the apparatus is selected in such a way as to detect the frequency spectrum of the flow rate, the apparatus indicating the passage of a perturbing agent modifying the composition of the medium. If the detector is a colour reading device, the apparatus makes it possible to detect the passage of a dye. If the detector associated with the apparatus is a turbidimeter the apparatus makes it possible to detect an emulsified formation, i.e. liquid-liquid, liquid-solid or liquid-gas. In this case, if a system of apparatuses according to the invention is disposed on for example a pipeline, it is possible to follow the advance of the separation front of two crude oils of different compositions.

The apparatus may also permit the checking of a surface state if the detector associated with the said apparatus is a mechanical sensing probe or an optical head. The apparatus may also be used to check the surface state of a liquid. Naturally, the surface state of a stationary liquid is level, but when boiled, the boiling operation leads to an increase in the size of the bubbles and the frequency of their formation. If the apparatus is equipped with a detector permitting the detection of this size or frequency, the apparatus also permits the definition of the boiling state of the liquid.

It is obvious that in the process and apparatus described hereinbefore the operating phases or the different means used could be replaced by equivalent phases or means without passing beyond the scope of the invention.

What is claimed is:

1. An apparatus for the detection of the presence of a physical phenomenon comprising:

a sensor sensitive to a characteristic magnitude of the phenomenon to be detected and able to supply a signal representative of said phenomenon;

at least one amplifier connected to the sensor output;

means for indicating passing beyond a predetermined threshold significant for the phenomenon to be detected, said means being connected to the amplifier output; wherein the means for indicating exceeding the significant threshold comprises:

a differentiating circuit connected to the amplifier output and supplying a signal which is the derivative relative to time of the signal representing the phenomenon;

a comparator whose one input is connected to the output of the differentiating circuit and whose other input is raised to a prealert reference potential, said comparator being able to supply a signal for initiating the prealert as soon as the amplitude of the differentiating circuit signal exceeds the amplitude of the reference potential;

a first time sampling circuit for fixing the elementary prealert periods of duration $\tau$ as soon as the comparator supplies a first signal for initiating the prealert;

a second time sampling circuit connected to said first sampling circuit for fixing alert periods of duration $T>\tau$ and a prealert counter having an input connected to an output of the first time sampling circuit and able to count during the alert periods of duration T the number $N_p$ of prealert sampling periods during which the reference potential is exceeded;

alert display means connected to the prealert counter output for indicating the presence of an alert during time T as soon as the number $N_p$ of prealerts exceeds a predetermined number $N_{al}$, the numbers $N_p$ and $N_{al}$ being whole numbers and the number $N_{al}$ being selected in such a way that $1<N_{al}<T/\tau$.

2. An apparatus according to claim 1, wherein the prealert reference potential is fixed as a function of the maximum background noise amplitude e accompanying the signal representative of the phenomenon during time $\tau$.

3. An apparatus according to claim 1, wherein means are provided for measuring the time interval $T-d_A$ between the end of an alert period T and the time $d_A$ necessary for counting $N_p$ prealerts in such a way as to define the significance of the phenomenon.

4. An apparatus according to claim 1, wherein the first sampling circuit comprises a prealert clock supplying pulses at frequency $1/\tau$ and a logic circuit associated with said clock and with the prealert counter in order to count the clock pulses on each occasion that the comparator supplies a prealert initiation signal during time $\tau$.

5. An apparatus according to claim 1, wherein the second sampling circuit comprises an alert clock supplying pulses at frequency $1/\tau$ and a logic circuit associated with said clock and an alert counter in such a way as to fix the alert period T as from the appearance of the first prealert.

6. An apparatus according to claim 5, wherein a bidirectional counter is associated with the alert and prealert counters in such a way as to count the difference $N-N_p$ between the number N of pulses supplied by the alert clock during time T and the number $N_p$ of prealert pulses counted by the prealert counter, said difference being proportional to the time interval $T-d_A$ representative of the significance of the phenomenon.

* * * * *